US006082369A

United States Patent [19]

Nevett et al.

[11] Patent Number: 6,082,369

[45] Date of Patent: Jul. 4, 2000

[54] PROCESS FOR TREATING TOBACCO

[75] Inventors: Robert Nevett; Clifford H. Henneveld; Keith A. Matthews, all of Bristol; Brian C. Chard, Nr Pensford, all of United Kingdom

[73] Assignee: Imperial Tobacco Limited, United Kingdom

[21] Appl. No.: 09/051,461

[22] PCT Filed: Oct. 19, 1995

[86] PCT No.: PCT/GB95/02468

§ 371 Date: Jul. 22, 1998

§ 102(e) Date: Jul. 22, 1998

[87] PCT Pub. No.: WO97/14322

PCT Pub. Date: Apr. 24, 1997

[51] Int. Cl.[7] ..... A24B 3/10; A24B 15/00; A24B 3/18; A24B 15/30

[52] U.S. Cl. ..... 131/290; 131/291; 131/296; 131/276

[58] Field of Search ..... 131/276, 290, 131/291, 296

[56] References Cited

U.S. PATENT DOCUMENTS 3,575,178 4/1971 Stewart ..... 131/140

3,683,937 8/1972 Fredrickson et al. ..... 131/140 P

OTHER PUBLICATIONS

CRC Handbook of Chemistry and Physics, 66th edition, p. c–395, 1986.

*Primary Examiner*—Stanley S. Silverman
*Assistant Examiner*—Jacqueline A. Ruller
*Attorney, Agent, or Firm*—Larson & Taylor PLC

[57] ABSTRACT

Tobacco is treated using the following series of steps:

(1) subjecting in a chamber the tobacco to a reduced pressure of not greater than 70 mbar (7 kPa);

(2) impregnating the cell structure of the tobacco with isopentane vapor at a temperature in the range of from 70° C. to 90° C. and maintaining the tobacco in contact with isopentane vapor at a pressure of at least 4 bar (400 kPa) for up to 30 minutes to cause impregnation of the tobacco;

(3) removing excess isopentane vapor from the impregnated tobacco by evacuating the chamber, the pressure change being effected adiabatically;

(4) contacting the impregnated tobacco with steam to expand the tobacco; and (5) subjecting the expanded tobacco to a reordering process.

6 Claims, 4 Drawing Sheets

PROCESS FOR TREATING TOBACCO

The present invention relates to a process for treating tobacco. More particularly, it relates to a process for expanding tobacco to increase its filling capacity.

Tobacco leaves, after harvesting, are subjected to curing processes. As a result of water loss suffered during the curing process, the leaves undergo variable shrinkage. It is conventional practice in the tobacco industry to treat cured tobacco intended for cigar or cigarette manufacture to recover the shrinkage by increasing its filling capacity. It is generally considered that by treating the tobacco in this way the cellular structure of the cured tobacco leaf is expanded to a state similar to that found in the leaf prior to curing.

A number of processes exist for increasing the filling capacity of tobacco. These are widely used within the industry to achieve product recovery after curing. The present invention is based on the discovery that filler expansion levels similar to and sometimes better than those achieved by conventionally used expansion processes and hence recovery can be achieved by the use of isopentane as the expansion medium in the vapour phase in a carefully controlled process.

Accordingly, the invention provides a process for treating tobacco comprising a series of steps:

(1) subjecting in a chamber the tobacco to a reduced pressure of not greater than 70 mbar (7 kPa);
(2) impregnating the cell structure of the tobacco with isopentane vapour at temperatures in the range of 70° C. to 90° C. and maintaining the tobacco in contact with isopentane vapour at a pressure of at least 4 bar (400 kPa) for up to 30 minutes to cause impregnation of the tobacco structure;
(3) removing excess isopentane vapour from the impregnated tobacco by evacuating the chamber, the pressure change being effected adiabatically;
(4) contacting the impregnated tobacco with steam to expand the tobacco; and
(5) subjecting the expanded tobacco to vacuum re-ordering.

Figure 1:
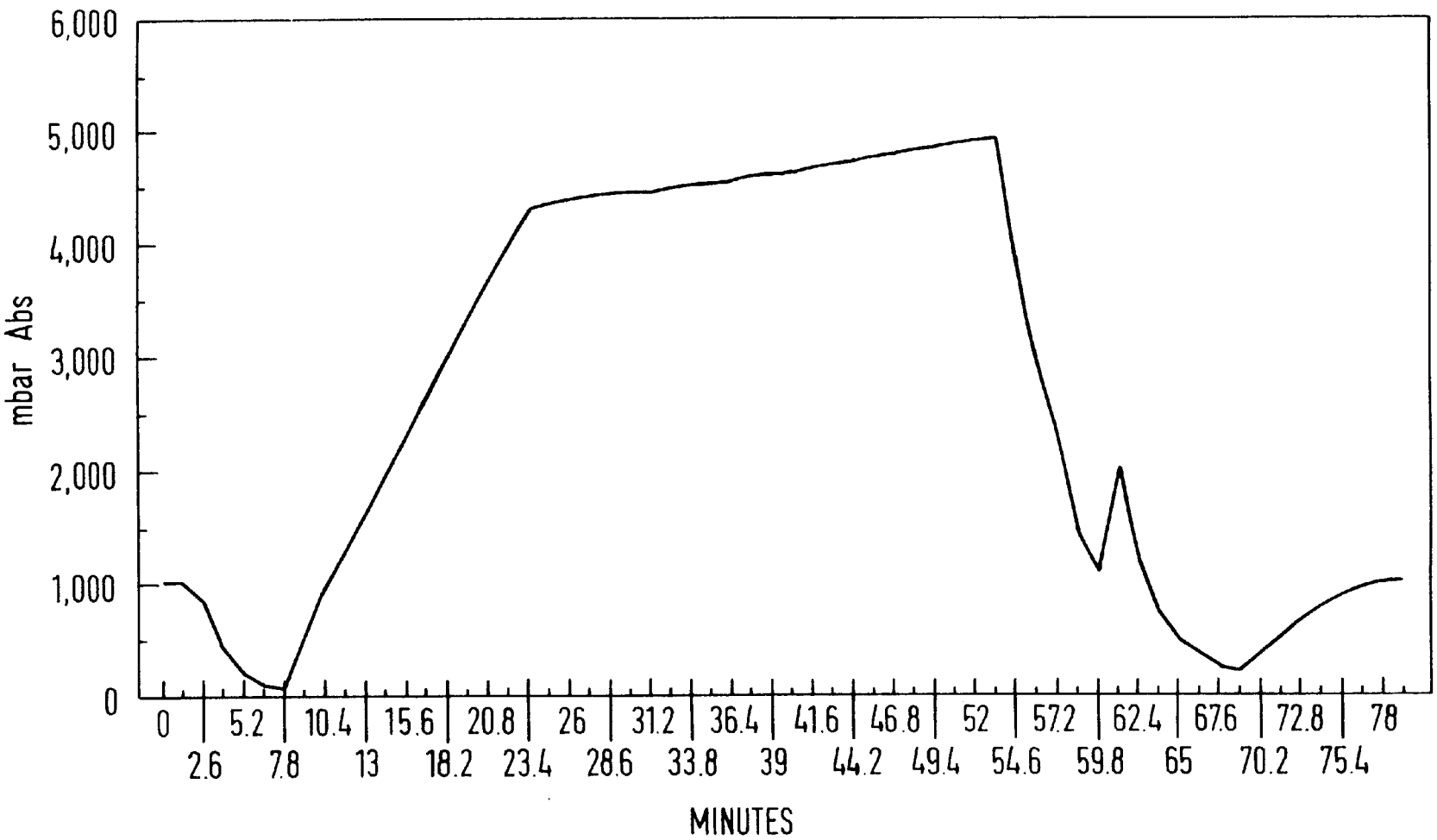
FIG. 1 is a graphical representation of the results of Example 1 showing the pressure values employed within the process chamber during the course of treatment in accordance with the present invention.

The tobacco which is treated according to the process of the invention will typically be in the form of pieces of cured tobacco leaf obtained by threshing, flailing or slicing whole cured leaves. The tobacco may alternatively be in the form of strips cut from whole leaf or may be shredded leaf. The tobacco to be treated will be arranged in baskets in the processing chamber.

The cured tobacco is, according to the present invention, subjected to a reduced pressure of not greater than 70 mbar (7 kPa). By this treatment, air in the processing chamber and air retained in pockets between tobacco leaf pieces or within the cell structure which would otherwise interfere with the subsequent impregnation of the cellular structure by the isopentane vapour is removed. The use of reduced pressures above 70 mbar do not sufficiently remove occluded air in the tobacco and, as a result, the subsequent impregnation of the tobacco cellular structure by isopentane vapour is impaired. Preferably, the pressure in the chamber is reduced below 70 mbar (7 kPa) as far as it is possible to do so and this is, of course, dictated by the performance of the evacuation and recovery system used. We have found that pressures in the range of from 40–70 mbar (4–7 kPa) are consistently achievable in this process and give good results.

Isopentane vapour is then pumped into the processing chamber. It is important in the invention that no liquid isopentane is allowed to enter the process chamber. Therefore, liquid isopentane stored outside the process chamber must be completely vaporised before it enters the process chamber and comes into contact with the tobacco. Since isopentane is a highly volatile and flammable solvent, engineering design of the process and recovery system must be carefully undertaken. The temperature of the isopentane vapour entering the chamber will be in the range of from 70° C. to 90° C. Isopentane vapour having a temperature greater than 90° C. should not be used in the invention since it impairs the subsequent steam expansion treatment and does not enable sufficient expansion of the tobacco to be achieved. Furthermore, if the heat exchanger is set to produce isopentane vapour at a temperature less than 70° C. there is a risk that liquid isopentane might pass through and enter the process chamber. Isopentane vapour at such a temperature might, on entering the chamber, be cooled by the contents of the chamber to the extent that it condenses. The effect of allowing liquid isopentane into the process chamber is to disrupt the process. Firstly, any liquid isopentane present in the chamber will take energy out of the system as it evaporates. Secondly, the energy requirements of the excess isopentane recovery procedures will be increased.

The amount of isopentane impregnating the cells in the tobacco leaf is controlled by the pressure of isopentane vapour created in the process chamber. The isopentane vapour is injected into the chamber until an internal pressure of at least 4000 mbar (400 kPa), preferably in the range of from 4000–4500 mbar (400–450 kPa), is achieved. When this pressure value is reached, the chamber is sealed after which the internal pressure will continue to rise (typically to about 5000 mbar (500 kPa)) as the temperature of the isopentane vapour continues to rise. The tobacco is maintained in contact with isopentane vapour at a pressure of at least 4000 mbar (400 kPa) for up to 30 minutes to allow complete penetration of the tobacco leaf cells by the isopentane to occur. We have found that optimum expansion of the tobacco is achieved by maintaining the high pressure for about 30 minutes. During the impregnation phase, it is assumed that isopentane appearing within the cell structure is squeezed under pressure into the liquid phase.

As soon as this time period has elapsed all excess isopentane vapour is removed from the chamber by reducing the pressure in the chamber as quickly as possible preferably to about atmospheric pressure. The change in pressure is, thus, adiabatic. By ensuring an adiabatic change in pressure, disruption and breakage of the cellular structure which would be catastrophic is avoided. We have found that this pressure reduction can be achieved in less than 15–20 minutes, typically about 15 minutes.

Immediately following the evacuation of the chamber, the temperature of the impregnated tobacco is caused to increase rapidly by contacting the tobacco with steam. As a consequence of the rise in temperature, the isopentane liquid bound inside the tobacco leaf cells undergoes a volume increase and is released causing the cellular structure of the tobacco to expand. Electron microscopy reveals that the cell-walls have swollen as a result of this treatment. In addition, the surface of the leaf appears to roughen. Typically, the steam is introduced into the chamber to raise the pressure therein to a value in the range of from 1000 mbar (100 kPa) to 1400 mbar (140 kPa) and preferably from 1000 to 1200 mbar (100 to 120 kPa). Care should be taken with the addition of the steam so as not to create turbulence inside the chamber which would have a detrimental effect on the tobacco expansion. Preferably the expansion stage is considered to be complete when the steam exhausted from the chamber by the evacuation and recovery system has risen to a temperature of 90 to 95° C. especially about 94° C. At this point the introduction of steam is discontinued. The time period from the start of the steam introduction to the achievement of this exhaust temperature should preferably not be greater than 4 minutes and if possible not greater than 2 minutes.

Immediately following completion of the expansion stage, the expanded tobacco is subjected to evaporative re-ordering to achieve the final desired expansion and moisture content. Typically, the final moisture content of the tobacco will be as close as possible to the level prior to the process. Re-ordering may, in general, be achieved by evacuation of the process chamber, following completion of the expansion stage, to a pressure in the range of 180–220 mbar (18–22 kPa). Thereafter, the pressure is returned isothermally back to atmospheric and the expanded tobacco removed from the process chamber.

The thus-treated tobacco may then, if required, be blended in the usual way and then conveyed to a cigar or cigarette production site as required.

In order to measure the filling value of a cured, threshed cigar tobacco product as described in the following examples, a filling value apparatus is used which is essentially composed of a cylinder 64 mm in diameter into which a piston 63 mm in diameter slides. The piston has a graduated seal on the side. Pressure is applied to the piston and volume in millilitres of a given weight of tobacco, 14.18 g is—determined. Experiments have shown that this apparatus will accurately determine the filling value of a given amount of threshed cigar tobacco with good reproducibility. The pressure on the tobacco applied by the piston in all examples was 12.8 kPa applied for 10 minutes at which time the filling value reading was taken. The moisture content of the tobacco affects the filling values determined by this method, therefore comparative filling values were obtained at similar moisture contents.

EXAMPLE 1

150 kg of a cured, threshed cigar tobacco containing 14 to 14.5% moisture and having a filling value of 5.08 cc/g when determined by the procedure previously indicated was arranged in baskets and treated according to the process of the invention. The tobacco was subjected to a reduced pressure of 64 mbar (6.4 kPa) and isopentane vapour in the range 70° C. to 90° C. was then pumped into the process chamber raising its pressure to 4300 mbar (430 kPa). The tobacco was maintained in contact with the isopentane for 30 minutes, at the end of which time the pressure had risen to 4964 mbar. All excess isopentane vapour was removed from the chamber by adiabatically reducing the pressure to 1100 mbar (110 kPa) over a period of about 6 minutes. Following this evacuation steam was injected into the process chamber until the steam exhausted from the chamber by the evacuation and recovery system had risen to 104° C. Evaporative re-ordering by further evacuation of the chamber to a pressure of 200 mbar (20 kPa) was finally followed by return to atmospheric pressure and removal of the expanded tobacco from the process chamber. The final filling value of the tobacco was 8.14 cc/g and moisture content 14% to 14.5%.

Figure 2:
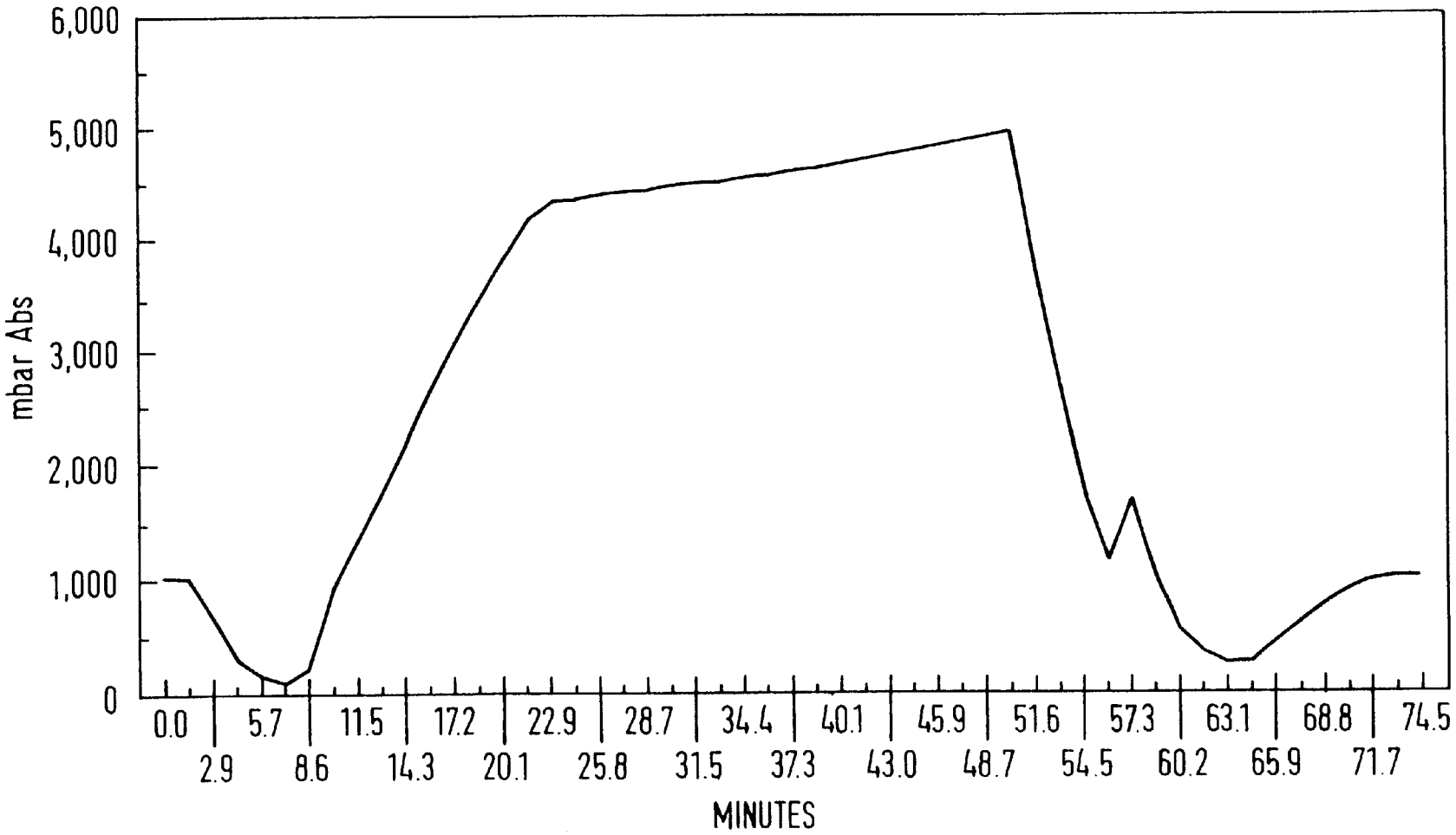
FIG. 2 is a graphical representation of the results of Example 2 showing the pressure values employed within the process chamber during the course of treatment in accordance with the present invention.
Figure 3:
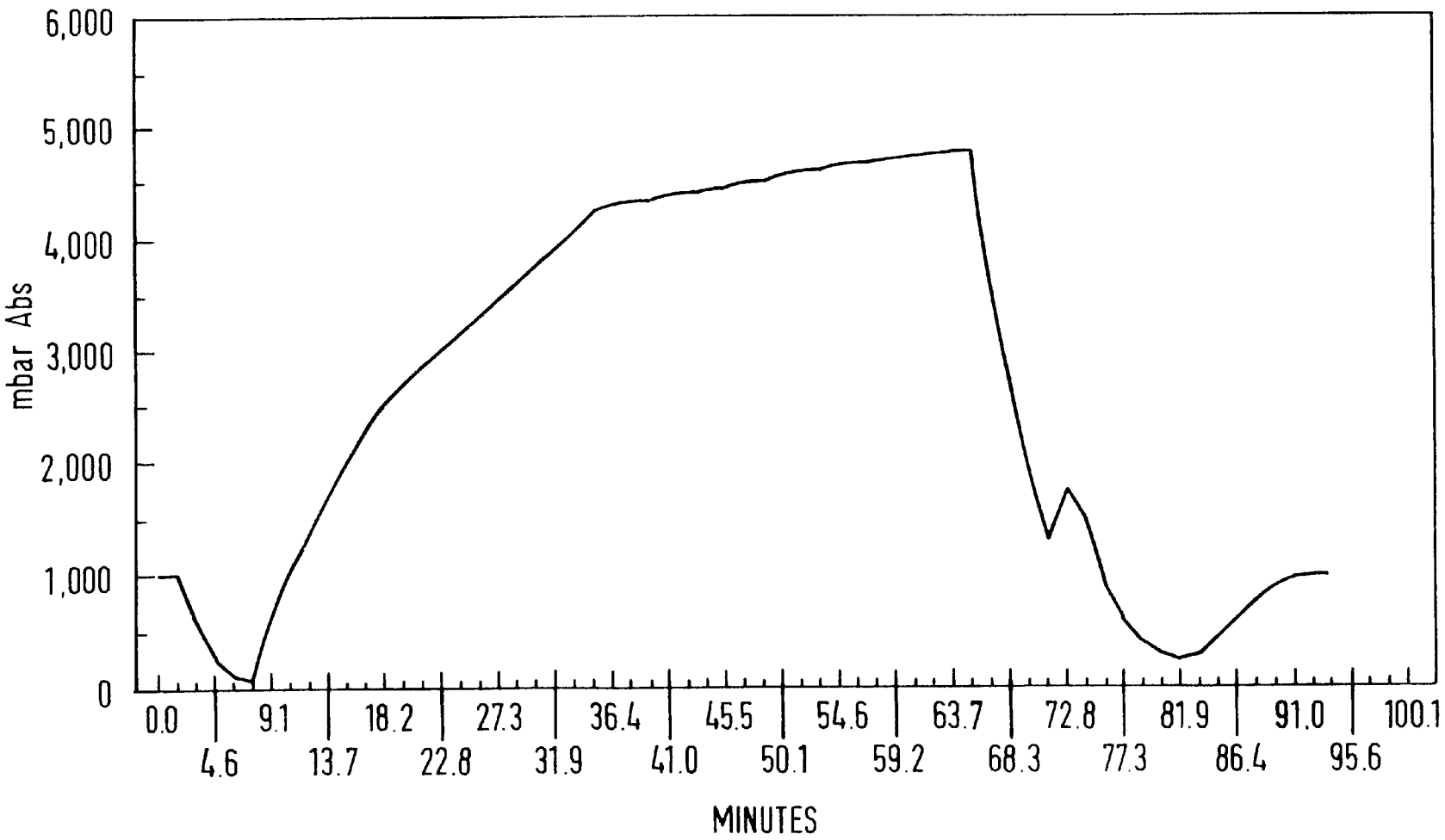
FIG. 3 is a graphical representation of the results of Example 3 showing the pressure values employed within the process chamber during the course of treatment in accordance with the present invention.
Figure 4:
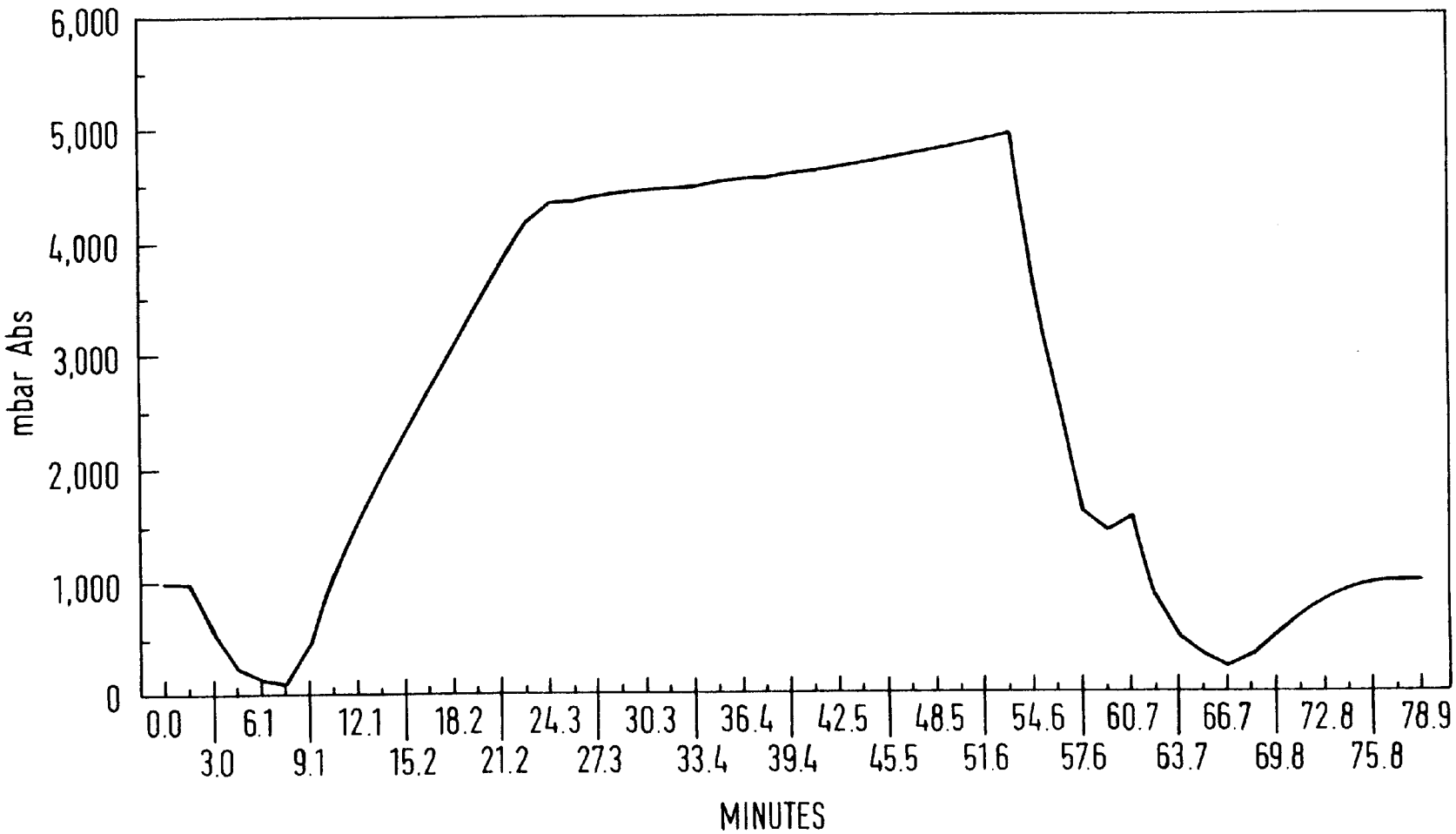
FIG. 4 is a graphical representation of the results of Example 4 showing the pressure values employed within the process chamber during the course of treatment in accordance with the present invention.

The procedure of Example 1 was repeated on further cycles of tobacco and the results noted in Table 1. Process parameters for Examples 2, 3 and 4 were the same as Example 1 unless stated. The pressure values employed within the process chamber during the full period of the treatment in accordance with Examples 1 to 4 are shown in graphical form in FIGS. 1 to 4 respectively.

TABLE 1

| | Example 2 | Example 3 | Example 4 |
|---|---|---|---|
| Filling values (cc/g) | | | |
| Before | 5.04 | 4.74 | 4.67 |
| After | 8.23 | 8.60 | 8.33 |
| Chamber pressure at end of impregnation phase (mbar) | 4975 | 4811 | 4974 |
| Steam temperature exiting chamber at end of expansion phase (° C.) | 103 | 104 | 104 |

What is claimed is:

1. A process for treating tobacco comprising a series of steps:

(1) subjecting in a chamber the tobacco to a reduced pressure of not greater than 70 mbar (7 kPa);

(2) impregnating the cell structure of the tobacco with isopentane vapour at a temperature in the range of from 70° C. to 90° C. and maintaining the tobacco in contact with isopentane vapour at a pressure of at least 4 bar (400 kPa) for up to 30 minutes to cause impregnation of the tobacco;

(3) removing excess isopentane vapour from the impregnated tobacco by evacuating the chamber, the pressure change being effected adiabatically;

(4) contacting the impregnated tobacco with steam to expand the tobacco to produce expanded tobacco; and (5) subjecting the expanded tobacco to a re-ordering process.

2. A process according to claim 1, wherein in step (1) the tobacco is subjected to a reduced pressure in the range of 40–70 mbar (4–7 kPa).

3. A process according to claim 1, wherein in step (2) the tobacco is maintained in contact with the isopentane vapour at a pressure in the range of 4000–4500 mbar (400–450 kPa) for about 30 minutes.

4. A process according to claim 1, wherein in step (4) the steam is introduced into the chamber to raise the pressure to a value of from 1000 to 1400 mbar (100–140 kPa).

5. A process according to claim 4, wherein the introduction of steam into the chamber is discontinued when the temperature of exhaust steam allowed to leave the chamber reaches 90–95° C.

6. A process according to claim 1, wherein the re-ordering process comprises subjecting the expanded tobacco to vacuum drying at reduced pressure in the range of from 180–220 mbar (18–22 kPa).

* * * * *